US005722433A

United States Patent [19]

Ishino et al.

[11] Patent Number: 5,722,433

[45] Date of Patent: Mar. 3, 1998

[54] WATER-DISPERSIBLE SHEET FOR CIGARETTES AND CIGARETTE USING THE SAME

[75] Inventors: Yoshiaki Ishino, Fuji; Masato Shishikura, Numazu; Toru Tsujimoto; Susumu Minamisawa, both of Tokyo, all of Japan

[73] Assignees: Mishima Paper Co., Ltd., Shizuoka-Ken; Japan Tobacco Inc., Tokyo, both of Japan

[21] Appl. No.: 689,041

[22] Filed: Jul. 30, 1996

[30] Foreign Application Priority Data

Aug. 9, 1995 [JP] Japan ..... 7-222779

[51] Int. Cl.[6] ..... A24D 3/02

[52] U.S. Cl. ..... 131/365; 131/331; 131/361; 131/362; 162/139; 428/372

[58] Field of Search ..... 131/365, 345, 131/361, 362, 77; 162/139, 158, 157.6, 100; 493/39–50; 428/372, 326, 327, 378, 393

[56] References Cited

U.S. PATENT DOCUMENTS

| | | | |
|---|---|---|---|
| 5,453,144 | 9/1995 | Kauffman et al. | 131/365 X |
| 5,462,801 | 10/1995 | Willmund | 428/372 |

FOREIGN PATENT DOCUMENTS

| | | |
|---|---|---|
| 43-1214 | 1/1943 | Japan . |
| 43-28766 | 12/1943 | Japan . |
| 48-27605 | 8/1973 | Japan . |
| 1-168999 | 7/1989 | Japan . |
| 3-8897 | 1/1991 | Japan . |
| 3-167400 | 7/1991 | Japan . |
| 3-180585 | 8/1991 | Japan . |
| 6-184984 | 7/1994 | Japan . |

*Primary Examiner*—Vincent Millin
*Assistant Examiner*—Kelly O'Hara
*Attorney, Agent, or Firm*—Birch, Stewart, Kolasch & Birch, LLP

[57] ABSTRACT

A water-dispersible sheet for cigarettes and a cigarette using the sheet are described. The sheet comprises a water-resolvable base paper and a water-dispersible coating layer containing water-soluble polymer formed on the surface of the base paper, whereby the sheet is adjusted to have an air-permeability of not more than 200 coresta measured with a paper permeability meter, or to have an air-resistance within the range of 0 to 50000 second/100 ml measured with an Oken type air-resistance tester. The water-resolvable base paper is made from fibrous raw materials containing not less than 20% by weight of water-dispersible fibers having fiber dimensions of a l/D value of 0.45 or lower and a L/D value of 60 or lower and a water-retention value of 95% or lower. The sheet is suitable for use as filter joining paper or filter plug wrap for cigarettes.

13 Claims, No Drawings

WATER-DISPERSIBLE SHEET FOR CIGARETTES AND CIGARETTE USING THE SAME

BACKGROUND OF THE INVENTION

1. Field of the Invention

The present invention relates to water-dispersible sheets suitable as filter plug wrap (plug paper) which is used for wrapping filter material for cigarettes, or as filter joining paper (tipping paper) which is used for joining a filter part to a cigarette part. The present invention further relates to cigarettes using said water-dispersible sheets.

2. Description of the Background Art

It is necessary that filter plug wrap (plug paper) or filter joining paper (tipping paper) for filter-tipped cigarettes has properties of relatively low gas-permeability, high opacity, high smoothness, high strength, and so on. The gas-permeability should be a relatively low value within the range of not more than 200 coresta, in order to prevent air from penetrating through the surface of filter plug wrap and filter joining paper, and from excessively diluting smoke in the cigarette. Therefore, the filter plug wrap and the filter joining paper have been produced under the condition of a high beating degree, or by using pulp made from some kinds of woods capable of forming low gas-permeable sheets.

Thus, when the gas-permeability of paper is reduced, the water-dispersibility of the paper deteriorates. Accordingly, there is a problem that filter plug wrap and filter joining paper of cigarette butt thrown away are hardly dispersed by rainwater.

The filter plug wrap and the filter joining paper should be produced from a paper web having high water-dispersibility in order that they can disperse by rainwater in natural environment.

As water-soluble paper having high water-dispersibility, there have been proposed, for example, paper produced from a mixture of paper-making fibers and fibrous carboxymethyl cellulose with alkali metal compounds (Japanese Patent Publication No. Sho 43-1214, 43-28766, 48-27605), paper produced by mixing inorganic powder which is insoluble or slightly-soluble in water with paper-making fibers or carboxymethyl cellulose (Japanese Patent Laid-Open No. Hei 3-8897, Hei 3-180585), and paper made from a paper stock containing alkali metal salt or alkaline earth metal salt of carboxymethyl cellulose (Japanese Patent Laid-Open No. Hei 1-168999, Hei 3-167400, Hei 6-184984). Since the property of low gas-permeability is not required in the use of the above prior water-soluble papers, the gas-permeability is not taken into account and those papers have extremely high gas-permeability. Usually, the higher the water-dispersibility of a kind of paper, the higher the gas-permeability of the paper. Consequently, water-dispersible paper having an air-permeability adjusted within the prescribed low level has not yet been provided.

Generally speaking, when the beating degree of wood pulp is reduced or the quantity of filler is increased for the purpose of good water-dispersibility, the gas-permeability of the paper becomes higher, so that it becomes unsuitable for use as the filter plug wrap or filter joining paper for filter tipped cigarettes.

SUMMARY OF THE INVENTION

Accordingly, it is an object of the present invention to provide water-dispersible sheets, which are suitable for use as filter plug wrap (plug paper) or filter joining paper (tipping paper) for filter-tipped cigarettes, having simultaneously a property of gas-permeability adjusted within the prescribed low level and a property of high water-dispersibility. These properties are usually opposite to each other.

It is found by the inventors that the water dispersibility of the base paper is enhanced by using, as fibrous raw materials, water-dispersible fibers having specified fiber-dimensions and a specified water retention value, or by mixing various additives with a paper stock for the base paper, or by treating a paper web with alkali, or by incorporating these steps. The present invention has been accomplished to obtain sheets having high water-dispersibility as well as low gas-permeability suitable for use as filter plug wrap or filter joining paper for filter-tipped cigarettes by forming a water-dispersible coating layer on the surface of the base paper in order to control the gas-permeability.

According to the first embodiment of the invention, there is provided a water-dispersible sheet for cigarettes, which comprises (1) a water-resolvable base paper made from fibrous raw materials containing not less than 20% by weight of water-dispersible fibers having fiber dimensions of a l/D value of 0.45 or lower and a L/D value of 60 or lower and a water-retention value of 95% or lower, and (2) a water-dispersible coating layer containing water-soluble polymer formed on the surface of at least one side of said base paper, whereby said sheet is adjusted to have an air-permeability of not more than 200 coresta measured with a paper permeability meter, or to have an air-resistance within the range of 0 to 50000 second/100 ml measured with an Oken type air-resistance tester.

According to the second embodiment of the invention, there is provided a water-dispersible sheet for cigarettes, which comprises (1) a water-resolvable base paper made from fibrous raw materials containing not less than 20% by weight of water-dispersible fibers having fiber dimensions of a l/D value of 0.45 or lower and a L/D value of 60 or lower and a water-retention value of 95% or lower, wherein water-insoluble or water-slightly-soluble powder is mixed with said fibrous raw materials, and (2) a water-dispersible coating layer containing water-soluble polymer formed on the surface of at least one side of said base paper, whereby said sheet is adjusted to have an air-permeability of not more than 200 coresta measured with a paper permeability meter, or to have an air-resistance within the range of 0 to 50000 second/100 ml measured with an Oken type air-resistance tester.

According to the third embodiment of the invention, there is provided a water-dispersible sheet for cigarettes, which comprises (1) a water-resolvable base paper made through an alkali impregnation treatment for a paper web formed from fibrous raw materials containing not less than 20% by weight of water-dispersible fibers having fiber dimensions of a l/D value of 0.45 or lower and a L/D value of 60 or lower and a water-retention value of 95% or lower, and (2) a water-dispersible coating layer containing water-soluble polymer formed on the surface of at least one side of said base paper, whereby said sheet is adjusted to have an air-permeability of not more than 200 coresta measured with a paper permeability meter, or to have an air-resistance within the range of 0 to 50000 second/100 ml measured with an Oken type air-resistance tester.

According to the fourth embodiment of the invention, there is provided a water-dispersible sheet for cigarettes, which comprises (1) a water-resolvable base paper made through an alkali impregnation treatment for a paper web formed from fibrous raw materials containing not less than 20% by weight of water-dispersible fibers having fiber dimensions of a l/D value of 0.45 or lower and a L/D value of 60 or lower and a water-retention value of 95% or lower, wherein water-insoluble or water-slightly-soluble powder is mixing with said fibrous raw materials, and (2) a water-dispersible coating layer containing water-soluble polymer formed on the surface of at least one side of said base paper, whereby said sheet is adjusted to have an air-permeability of not more than 200 coresta measured with a paper permeability meter, or to have an air-resistance within the range of 0 to 50000 second/100 ml measured with an Oken type air-resistance tester.

According to the fifth embodiment of the invention, there is provided a water-dispersible sheet for cigarettes, which comprises (1) a water-resolvable base paper made from fibrous raw materials containing not less than 20% by weight of water-dispersible fibers having fiber dimensions of a l/D value of 0.45 or lower and a L/D value of 60 or lower and a water-retention value of 95% or lower, wherein salt of fibrous carboxymethyl cellulose or salt of fibrous carboxyethyl cellulose is mixed with said fibrous raw materials, and (2) a water-dispersible coating layer containing water-soluble polymer formed on the surface of at least one side of said base paper, whereby said sheet is adjusted to have an air-permeability of not more than 200 coresta measured with a paper permeability meter, or to have an air-resistance within the range of 0 to 50000 second/100 ml measured with an Oken type air-resistance tester.

According to the sixth embodiment of the invention, there is provided a water-dispersible sheet for cigarettes, which comprises (1) a water-resolvable base paper made from fibrous raw materials containing not less than 20% by weight of water-dispersible fibers having fiber dimensions of a l/D value of 0.45 or lower and a L/D value of 60 or lower and a water-retention value of 95% or lower, wherein salt of fibrous carboxymethyl cellulose or salt of fibrous carboxyethyl cellulose and water-insoluble or water-slightly-soluble powder are mixed with said fibrous raw materials, and (2) a water-dispersible coating layer containing water-soluble polymer formed on the surface of at least one side of said base paper, whereby said sheet is adjusted to have an air-permeability of not more than 200 coresta measured with a paper permeability meter, or to have an air-resistance within the range of 0 to 50000 second/100 ml measured with an Oken type air-resistance tester.

According to the seventh embodiment of the invention, there is provided a water-dispersible sheet for cigarettes, which comprises (1) a water-resolvable base paper made through an alkali impregnation treatment for a paper web formed from fibrous raw materials containing water-dispersible fibers and fibrous carboxymethyl cellulose acid or fibrous carboxyethyl cellulose acid, and (2) a water-dispersible coating layer containing water-soluble polymer formed on the surface of at least one side of said base paper, whereby said sheet is adjusted to have an air-permeability of not more than 200 coresta measured with a paper permeability meter, or to have an air-resistance within the range of 0 to 50000 second/100 ml measured with an Oken type air-resistance tester.

According to the eighth embodiment of the invention, there is provided a water-dispersible sheet for cigarettes, which comprises (1) a water-resolvable base paper made through an alkali impregnation treatment for a paper web formed from fibrous raw materials containing water-dispersible fibers and fibrous carboxymethyl cellulose acid or fibrous carboxyethyl cellulose acid, wherein water-insoluble or water-slightly-soluble powder is mixed with said fibrous raw materials, and (2) a water-dispersible coating layer containing water-soluble polymer formed on the surface of at least one side of said base paper, whereby said sheet is adjusted to have an air-permeability of not more than 200 coresta measured with a paper permeability meter, or to have an air-resistance within the range of 0 to 50000 second/100 ml measured with an Oken type air-resistance tester.

DETAILED DESCRIPTION OF THE INVENTION (Making of water-resolvable base paper)

In the present invention, water-dispersible fibers used for making the water-resolvable base paper are fibrous raw materials having a property of substantially dispersing in water, and are generally used for paper-making. The water-dispersible fibers are selected from, for example, wood pulp fibers such as soft-wood kraft pulp, hard-wood kraft pulp or dissolving pulp, and non-wood plant fibers such as kenaf pulp, flax pulp or linter pulp. The average fiber length of the water-dispersible fibers is from 0.1 to 10 mm, preferably from 0.5 to 3 mm, more preferably from 0.8 to 2 mm.

Especially, the above-mentioned first to sixth embodiments of the present invention are characterized by using fibers having specified fiber dimensions and a specified water retention value at the time before beating.

The fiber dimensions denote values calculated by the following formulas (1) and (2) on the bases of the fiber length (L), the fiber diameter (D) and the fiber lumen diameter (l) which are measured with a optical microscope.

$$l/D=l+D \quad (1),$$

$$L/D=L+D \quad (2)$$

The water retention value is an index of a swelling value of pulp defined in JAPAN TAPPI No.26, and indicates a ratio of water held in swelling fibers in the whole pulp.

The water-dispersible fibers used in the above first to sixth embodiments of the present invention should simultaneously satisfy the requirements of a l/D value of 0.45 or lower, a L/D value of 60 or lower and a water retention value of 95% or lower at the time before beating.

The wood pulp fibers or the non-wood plant fibers, in which the l/D value is 0.45 or lower, the L/D value is 60 or lower and the water retention value is 95% or lower, used as water dispersible fibers in the above first to sixth embodiments, are hard to be swollen or collapsed in the process of forming a sheet by drainage and drying, and bondings of the fibers one another are weak, so that the fibers are easy to disperse in water.

The fiber dimensions and the water retention value depend on a kind of woods or plants which are used as raw materials for pulp. Therefore, in order to obtain pulp having the prescribed values of l/D, L/D and the water retention, pulp produced from selected kinds of woods or plants may be used. There can be given examples, woods such as quercus (oak), populus (aspen), magnolia, eucalyptus and so forth or non-wood plants such as esparto grass and so forth. The pulp having the prescribed fiber dimensions and the prescribed water retention value as mentioned above can be obtained by selecting from the commercially available pulp or by mixing plural kinds of pulps as required.

The water-dispersible fibers employed in the first to sixth embodiments of the present invention are dispersed in water or subject to beating prior to use. If the beating degree is increased, the bondings between fibers increase and both the water-dispersibility and the gas-permeability of the base paper become lower. Therefore, if the beating degree is too much increased, the water-dispersibility of the sheet becomes insufficient, but in contrast, if the beating degree is too much reduced, the gas-permeability of the sheet becomes higher in excess and the strength of the sheet deteriorates.

In the cases of the first, third and fifth embodiments of the present invention, it is preferable to adjust the beating degree in the range from 140 ml CSF to 650 ml CSF by Canadian standard freeness or in the range from 17° SR to 60° SR by Schopper-Riegler freeness.

In the cases of the second, fourth and sixth embodiments of the present invention, owing to the addition of water-insoluble or water-slightly-soluble powder into the paper stock, the water-dispersibility of the sheet is improved. Therefore, the beating degree can be increased more than that in the case of the first, third or fifth embodiment and it is preferable to adjust the beating degree in the range from 60 ml CSF to 650 ml CSF by Canadian standard freeness or in the range from 17° SR to 72° SR by Schopper-Riegler freeness.

In the first to sixth embodiments of the present invention, the content of the water-dispersible fibers should be not less than 20% (weight) of the whole amount of fibrous raw materials. The water-dispersible fibers may occupy the whole amount of the fibrous raw materials. If the weight proportion of the water-dispersible fibers is less than 20%, the water-dispersibility of the sheet will decrease excessively.

When the weight proportion of the water-dispersible fibers is less than 100% of the fibrous raw materials in the first to sixth embodiments, other wood pulp or non-wood plant pulp having the fiber dimensions and water retention value out of the above prescribed range can be contained in the paper stock up to 80% (weight) of the fibrous raw materials.

In the cases of the second, fourth and sixth embodiments of the present invention, water-insoluble or water-slightly-soluble powder is mixed with the fibrous raw materials in the process of making the water-resolvable base paper. The water-dispersibility and the opacity can be improved by the addition of the above powder into the paper stock. When the opacity of the sheet used as filter plug wrap or filter joining paper for cigarettes is low, filter materials in the filter plug are seen through and the outside appearance of the cigarettes looks bad. Therefore, it is preferable for the sheet used as the filter plug wrap or the filter joining paper for cigarettes to have high opacity.

In the second, fourth and sixth embodiments of the present invention, the water-insoluble powder, which is mixed with the fibrous raw materials in the paper stock for making the water-resolvable base paper, includes nonmetal inorganic compounds, metals, water-insoluble inorganic salt, thermosetting resin powder and thermoplastic resin powder. The water-slightly-soluble powder includes water-slightly-soluble inorganic salt.

The concrete examples of the water-insoluble powder are as follows and the powder can be used separately or together by selecting at least one from the following powder and sometimes together with the water-slightly-soluble powder mentioned later.

- metal oxides such as aluminium oxide, titanium oxide
- carbides such as silicon carbide, boron carbide
- nitrides such as tri-silicon tetra-nitride, boron nitride
- silicate minerals such as mica, feldspar, silica minerals, clay minerals, synthetic zeolite, natural zeolite
- titanate compounds such as potassium titanate, barium titanate
- silicate compounds such as magnesium silicate phosphate compounds such as zinc phosphate
- fine powder of urea resin, fine powder of hollow styrene-acrylic resin The concrete examples of the water-slightly-soluble powder are as follows and the powder can be used separately or together by selecting at least one from the following powder and sometimes together with the above-mentioned water-insoluble powder.

- metal hydroxides such as aluminium hydroxide, magnesium hydroxide
- carbonate compounds such as calcium carbonate, barium carbonate, magnesium carbonate, zinc carbonate
- sulfate compounds such as barium sulfate, calcium sulfate, strontium sulfate The above mentioned water-insoluble powder or water-slightly-soluble powder is mixed with the fibrous raw materials in the paper stock for making a water-resolvable paper. It is preferable to adjust the amount of the powder so that the water-resolvable base paper may contain 4 to 40% powder by weight. If the content of the water-insoluble or water-slightly-soluble powder in the base paper is less than 4% by weight, the merit of improving the water-dispersibility or the opacity is insignificant, and so it is meaningless to add the powder. On the other hand, if the content of the water-insoluble or water-slightly-soluble powder in the base paper exceeds 40% by weight, the water-dispersibility and the opacity are remarkably improved, whereas the strength deteriorates terribly and the gas-permeability is greatly elevated and then it becomes difficult to adjust the gas-permeability within the prescribed range.

Remembering that a part of the powder flows out during the process of forming a wet web by drainage, generally, the powder is mixed with fibrous raw materials by selecting the content ratio of the water-insoluble or water-slightly-soluble powder in the range of from 1 to 200 parts, preferably from 5 to 100 parts, per 100 parts of fibrous raw materials by weight, so that the base paper may contain the above desired amount of the powder.

In the third and fourth embodiments of the present invention, the water-resolvable base paper is made through alkali impregnation treatment after the process of forming a paper web by drainage and drying.

As the water-dispersible fibers become easy to swell by alkali, the sheet produced through alkali treatment after the process of forming a paper web from water-dispersible fibers can be easy to swell and disperse in water and therefore the water-dispersibility of the sheet is enhanced. Alkaline compounds used in the alkali impregnation treatment include the following compounds and these compounds may be used separately or as mixtures of two or more of them. All of them must be soluble in water.

- hydroxides of alkali metals such as sodium hydroxide, potassium hydroxide
- carbonates and hydrogencarbonates of alkali metals such as sodium carbonate, potassium carbonate, sodium hydrogencarbonate
- phosphates and hydrogenphosphates of alkali metals such as sodium phosphate, sodium hydrogenphosphate
- alkali metal salts of organic acids such as sodium acetate
- hydroxides of alkaline earth metals such as calcium hydroxide
- amines such as ethanolamine The amount of the above alkali compounds absorbed in a paper web is from 0.05 $g/m^2$ to 20 $g/m^2$, preferably from 0.1 $g/m^2$ to 10 $g/m^2$, more preferably from 0.5 $g/m^2$ to 5 $g/m^2$.

The impregnation treatment is desirably carried out by the steps of dipping the paper web, after the process of forming the paper web by drainage and drying, into an aqueous solution of one of the above alkaline compounds or a mixed solution of said aqueous solution and a aqueous organic solvent having compatibility with said aqueous solution, and squeezing an excess of the solution from the paper web with a roll. Concretely, an apparatus such as a size press apparatus is preferably used.

Further, in order to prevent the alkaline compounds from falling off after drying, it is preferable to add water-soluble polymer having compatibility with the solution of the alkaline compounds into the solution.

In the fifth and sixth embodiments of the present invention, salt of fibrous carboxymethyl cellulose or salt of fibrous carboxyethyl cellulose is added into the paper stock for making the water-resolvable base paper.

The salt of fibrous carboxymethyl cellulose and the salt of fibrous carboxyethyl cellulose in themselves swell and gel in water, so that the fiber-bondings between said salts one another or between said salts and fibrous raw materials are easily dissociated and the sheet rapidly disperses in water.

The salt of fibrous carboxymethyl cellulose and the salt of fibrous carboxyethyl cellulose include salt of alkali metal such as sodium salt (CMC—Na, CEC—Na), potassium salt (CMC—K, CEC—K), lithium salt (CMC—Li, CEC—Li) and the like or mixed salt of said alkali metal salt and another salt such as ammonium salt, amine salt, calcium salt, magnesium salt, aluminium salt or the like.

The degree of substitution of the salt of fibrous carboxymethyl cellulose or the salt of fibrous carboxyethyl cellulose is from 0.1 to 1.5, preferably from 0.3 to 0.5.

The blend percentage of (the salt of fibrous carboxymethyl cellulose or the salt of fibrous carboxyethyl cellulose): (the whole fibrous raw materials including water-dispersible fibers) is from 1:99 to 50:50, preferably from 3:97 to 15:85, more preferably from 5:95 to 10:90.

In the seventh or eighth embodiments of the present invention, there is no need for water-dispersible fibers to have specified fiber dimensions and a specified water retention value as in the cases of the first to sixth embodiments. The water-dispersible fibers can be properly selected from, for example, wood pulp fibers such as soft-wood kraft pulp, hard-wood kraft pulp or dissolving pulp, and non-wood plant fibers such as kenaf pulp, flax pulp or linter pulp. The average fiber length of the water-dispersible fibers is from 0.1 to 10 mm, preferably from 0.5 to 3 mm, more preferably from 0.8 to 2 mm.

There is no limitation concerning the fiber dimensions and the water retention value in the seventh or the eighth embodiment, because the base paper has sufficient water-dispersibility by the addition of the fibrous carboxymethyl cellulose acid or the fibrous carboxyethyl cellulose acid with the process of an alkali treatment.

Further, in the seventh or eighth embodiment of the present invention, alkali treatment must be carried out uniformly in the direction of the thickness of the paper web. Therefore, it is necessary to produce a paper web having high impregnating ability by reducing the beating degree, and so it is preferable to adjust the beating degree in the range from 140 ml CSF to 720 ml CSF by Canadian standard freeness or in the range from 14° SR to 60° SR by Schopper-Riegler freeness.

In the seventh or eighth embodiment of the present invention, the paper stock contains fibrous carboxymethyl cellulose acid or fibrous carboxyethyl cellulose acid as one of the fibrous raw materials for making paper in addition to the water-dispersible fibers. These acids are CMC—H or CEC—H, and have no swelling ability, differing from the salt of fibrous carboxymethyl cellulose or the salt of fibrous carboxyethyl cellulose which is added into the base paper in the fifth or sixth embodiment of the present invention.

Therefore the above acids keep the fibrous state even in water and can be one of the fibrous raw materials for making paper. In order to control the water-dispersibility, up to 20% (weight) of CMC—H or CEC—H can be replaced by salt such as calcium salt (CMC—Ca, CEC—Ca), zirconium salt (CMC—Zr, CEC—Zr), magnesium salt (CMC—Mg, CEC—Mg), aluminium salt (CMC—Al CEC—Al), zinc salt (CMC—Zn, CEC—Zn) or the like. Two or more kinds of these salts may also be used together.

The degree of substitution of the fibrous carboxymethyl cellulose acid or the fibrous carboxyethyl cellulose acid is from 0.1 to 1.5, preferably from 0.3 to 0.5.

The beating degree of the fibrous carboxymethyl cellulose acid or the fibrous carboxyethyl cellulose acid is preferably in the range from 300 ml CSF to 750 ml CSF by Canadian standard freeness. If the beating degree is less than 300 ml CSF, the water-dispersibility deteriorates to be unsuitable for use.

In the seventh or eighth embodiment of the present invention, the blend percentage of the water-dispersible fibers is from 30 to 99% (weight) of the whole amount of the fibrous raw materials. As the remainder of the fibrous raw materials, the fibrous carboxymethyl cellulose acid or the fibrous carboxyethyl cellulose acid can be used, and further semisynthetic fibers, synthetic fibers or inorganic fibers can be mixed with the above fibers as required.

The blend percentage of the fibrous carboxymethyl cellulose acid or the fibrous carboxyethyl cellulose acid is from 1% to 50% (weight), preferably from 3% to 20% (weight), more preferably from 5% to 10% (weight) of the whole amount of the fibrous raw materials, on condition that the blend percentage of the semisynthetic fibers, synthetic fibers or inorganic fibers mixed as required must be up to 20% (weight), and the total weight of the water-dispersible fibers and the fibrous carboxymethyl cellulose acid or the fibrous carboxyethyl cellulose acid must occupy from 80 to 100% (weight) of the whole amount of the fibrous raw materials.

The alkaline compounds used in the alkali impregnation treatment in the seventh and the eighth embodiments include the following compounds and these compounds may be used separately or as a mixture of two or more of them. All of them must be water-soluble compounds.

- hydroxides of alkali metals such as sodium hydroxide, potassium hydroxide
- carbonates and hydrogencarbonates of alkali metals such as sodium carbonate, potassium carbonate, sodium hydrogencarbonate
- phosphates and hydrogenphosphates of alkali metals such as sodium phosphate, sodium hydrogenphosphate
- hydroxides of alkaline earth metals such as calcium hydroxide
- amines such as ethanolamine, and ammonia
- borates such as borax
- silicates such as sodium silicate An aqueous solution of one of the above alkaline compounds or a mixed solution of said aqueous solution and an aqueous organic solvent having compatibility with said aqueous solution is prepared and added to the paper web formed by drainage and drying. The amount of the alkaline compound added to the paper web should be not less than the neutralization equivalent obtained by converting the fibrous carboxymethyl cellulose acid (CMC—H) or the fibrous carboxyethyl cellulose acid (CEC—H) into salts corresponding to the acids, preferably from once to twice as much as said neutralization equivalent.

The preferable method of the addition of the alkaline compound to the paper web is as follows:

The paper web is dipped into the aqueous solution of the above alkaline compound or the mixed solution of said aqueous solution and an aqueous organic solvent having compatibility, and then an excess of the solution is squeezed from the paper web with a roll. Concretely, the addition process is carried out by using an apparatus such as a size press apparatus.

It is desirable to adjust the freeness and the basis weight, in order that the water-resolvable base papers made according to the first to the eighth embodiments respectively may have the air-permeability of not more than 40000 coresta. If the air-permeability of the base paper exceeds 40000 coresta, it becomes difficult to control the air-permeability of a coated paper produced from the base paper to be at the level of not more than 200 coresta, although a water-dispersible coating layer is formed on the base paper and also a super-calendering is carried out.

When the air-permeability of the water-resolvable base paper is 40000 coresta or lower, there is no need for specially controlling the basis weight of the water-resolvable base paper in relation to the air-permeability. However, from the standpoint of the use such as filter plug wrap or filter joining paper for filter-tipped cigarettes, which is the object of the present invention, the desirable basis weight of the base paper is from 15 g/m$^2$ to 80 g/m$^2$, especially 25 g/m$^2$ to 45 g/m$^2$.

(Formation of the water-dispersible coating layer)

The first to the eighth embodiments of the present invention are characterized by that the coating layer comprising water-soluble polymer is formed on the surface(s) of one side or both sides of the water-resolvable base paper made according to the first to the eighth embodiments respectively. The reason for the formation of the coating layers is as follows:

In order that the water-dispersibility of the water-resolvable base paper can be improved, it is made from the pulp which is weak in bondings of fibers one another or in the combination states or it is made through the process of adding the additives for improving the water-dispersibility. Therefore, the resultant water-resolvable base paper is porous and has high gas-permeability. Consequently, it is necessary to control the air-permeability within the prescribed level being suitable for use as filter plug wrap or filter joining paper, by forming the coating layer.

As the water-soluble polymer, the following compounds can be used separately, or two or more of them can be used together.

- starch such as potato starch, corn starch
- starch derivatives such as oxidized starch, carboxymethyl starch, phosphate ester starch, hydroxyalkyl starch
- cellulose derivatives such as salt of carboxymethyl cellulose, salt of carboxyethyl cellulose, methyl cellulose, ethyl cellulose, hydroxyethyl cellulose
- polysaccharides constituting plants such as alginate, mannan
- synthetic polymers such as poly(vinyl alcohol), poly (vinylpyrolidone), poly(alkilene oxide), polyacrylate
- plant mucilage such as gum arabic, tragacanth gum
- microbial mucilage such as dextran, levan
- protein such as casein, glue, gelatin
- emulsion of copolymers containing acrylic ester unit, methacrylic ester unit or vinyl acetate unit The formation of the coating layer is carried out by applying a coating liquid (a coating color, or a coating mixture) comprising water-soluble polymer and water to the surface(s) of one side or both sides of the water-resolvable base paper with a roll coater or a blade coater. The coating layer is formed from the coating liquid, while a part of the coating liquid is absorbed in the base paper. When the air-permeability of the sheet after coating is not more than 600 coresta, it is possible to adjust the ultimate air-permeability to be not more than 200 coresta by calendering. Therefore the coating liquid is applied to the surface(s) of one side or both sides of the base paper so that the air-permeability after coating may be not more than 600 coresta. The coating amount is from 0.1 to 30 g/m$^2$, preferably 1 to 10 g/m$^2$, more preferably 2 to 6 g/m$^2$.

After the base paper is coated with the water-soluble polymer, calendering is carried out as occasion demand.

In the first to eighth embodiments of the present invention, the water-dispersible coating layer comprising water-soluble polymer on the surface(s) of one side or both sides of the water-resolvable base paper may contain the water-insoluble or water-slightly-soluble powder in the ratio of not more than 20 parts per 1 part of the water-soluble polymer by weight. When the water-dispersible coating layer comprising water-soluble polymer also contains water-insoluble or water-slightly-soluble powder, there is advantages that the opacity, the smoothness and the printability improve.

The water-insoluble or water-slightly-soluble powder is the same powder as that added into the water-resolvable base paper in the second, fourth and sixth embodiments of the present invention, that is, nonmetal inorganic compounds, metals, water-insoluble inorganic salt, thermosetting resin powder, thermoplastic resin powder or the like, or water-slightly-soluble inorganic salt can be employed.

The concrete examples of the water-insoluble powder are as follows and the powder can be used separately or together by selecting at least one from the following powder and sometimes together with the water-slightly-soluble powder mentioned later.

- metal oxides such as aluminium oxide, titanium oxide carbides such as silicon carbide, boron carbide nitrides such as tri-silicon tetra-nitride, boron nitride silicate minerals such as mica, feldspar, silica minerals, clay minerals, synthetic zeolite, natural zeolite titanate compounds such as potassium titanate, barium titanate silicate compounds such as magnesium silicate phosphate compounds such as zinc phosphate fine powder of urea resin, fine powder of hollow styrene-acrylic resin The concrete examples of the water-slightly-soluble powder are as follows and the powder can be used separately or together by selecting at least one from the following powder and sometimes together with the above-mentioned water-insoluble powder.

metal hydroxides such as aluminium hydroxide, magnesium hydroxide carbonate compounds such as calcium carbonate, barium carbonate, magnesium carbonate, zinc carbonate sulfate compounds such as barium sulfate, calcium sulfate, strontium sulfate The mixing ratio of the water-insoluble or water-slightly-soluble powder to the water-soluble polymer in the coating layer is not more than 20 parts, preferably in the range of from 3 to 10 parts, per 1 part of the water-soluble polymer by weight. Even if the coating layer contains the above powder, the coating amount is from 0.1 to 30 g/m$^2$, preferably 1 to 10 g/m$^2$, more preferably 2 to 6 g/m$^2$ in the same manner as the case that the coating layer consists of the water-soluble polymer. After the coating layer is formed, calendering is carried out as required for improvement of the smoothness or the printablity and decrease of the air-permeability.

When the coating layers are formed on the surfaces of both sides of the water-resolvable base paper, the following cases are practicable:

the case of forming the coating layers consisting of the water-soluble polymer on the surfaces of both sides;

the case of forming the coating layers containing the water-insoluble or water-slightly-soluble powder on the surfaces of both sides; and the case of forming a coating layer consisting of the water-soluble polymer on the surface of one side and a coating layer containing the water-insoluble or water-slightly-soluble powder on the surface of the other side:

With respect to the water-dispersible sheet for cigarettes, The relation between the air-permeability measured with a paper permeability meter and the air-resistance measured with an Oken type air-resistance tester is investigated. As a result, the following regression equation is obtained.

$$(\text{air-permeability})=-0.418\times(\text{air-resistance})+56.85$$

In the region of extremely low gas-permeability such as less than 1 coresta of air-permeability, the air-resistance should be measured. From the above equation, it is found that the lager the value of the air-resistance, the lower the air-permeability. Further, when the air-permeability is 1 coresta, the air-resistance is 133.6 second/100 ml, and when the air-resistance is more than 133.6 second/100 ml, it is impossible to measure the air-permeability. On the other hand, it is impossible to measure the air-resistance when the air-permeability exceeds 56.85 coresta. Both of the air-permeability and the air-resistance are capable of measurement within the following range.

| | |
|---|---|
| air-permeability | 56.85 to 1 (coresta) |
| air-resistance | 0 to 133.6 (second/100 ml) |

The paper permeability meter is a permeability tester provided by FILTRONA Co., Ltd. for measuring the amount of air flow passing through 1 cm$^2$ surface of a sample at a differential pressure of 100 mm $H_2O$ . Herein, $$\begin{aligned} 1\ \text{coresta} &= 1\ \text{cm}^3\ \text{min}^{-1}\ \text{cm}^{-2}\ \text{kPa}^{-1} \\ &= 1\ \text{cm}^3\ \text{min}^{-1}\ \text{cm}^{-2}\ (100\ \text{mmH}_2\text{O})^{-1} \times 1/0.98 \end{aligned}$$

The Oken type air-resistance tester is an instrument for measuring the indicated value of water column manometer when the pressured air flows through 10.75 cm$^2$ surface of a sample, and the measured value is indicated by the unit of second/100 ml.

The above mentioned water-dispersible sheet for cigarettes according to the present invention is suitable for use as filter plug wrap or filter joining paper. The filter plug wrap as one of the stuffs for cigarettes is a sheet for enveloping filter materials, mainly cellulose acetate, to form columns. The filter joining paper is a sheet used for joining a cigarette part in which cigarette-paper envelopes tobacco, to a filter plug part in which the filter-plug-wrap envelopes filter materials. These stuffs for cigarettes should have various properties.

The first is a property for controlling air-permeability. The amount of air flowing into filter during smoking can be increased by making paper porous mechanically or with laser, or by using paper having high air-permeability, so that components in cigarette-smoke, such as tar or nicotine, are diluted, and the amount of the components in cigarette-smoke during smoking is reduced. With respect to the relations between the air-permeability or porosity of paper and the amount of the components in smoke, various knowledges have been obtained, and then the amount of the components in smoke is controlled in designs and manufactures of cigarette products. In the prior arts for the water-soluble paper or the water-resolvable paper, it is impossible to control the amount of tar and nicotine because the amount of air flowing through said paper is over the air-permeability obtained by perforating the paper, or the air-permeability of the paper itself is too high. Therefore, the prior arts have defects that it becomes impossible to make discrimination among cigarette products. It is possible to control the amount of components in smoke by using the water-dispersible sheet according to the present invention.

The second property is printability required for filter joining paper. The discrimination among cigarette products and the improvement of product image are attempted with printing patterns on the filter joining paper. Paper produced according to the prior arts for the water-soluble paper or the water-resolvable paper is porous and has low smoothness. Therefore, various phenomena occur, that is, ink passes through the paper to the other side during printing and the amount of ink on the surface decreases to result in that the printing merit declines, what is called "strike through", or ink on the printed surface becomes uneven, what is called "mottling", or in the case of printing such as gravure printing, the number of missing-dots left out of printing increases. In contrast, in the present invention, the surface of the base paper is coated with a coating liquid containing water-soluble polymer, so that the smoothness of the surface is elevated and the above defects during printing can be removed.

On account of satisfying these functions and utilizing the present invention concerning a sheet having high water-dispersibility, cigarettes with filters, which is accelerated to be decomposed in natural environment, can be provided without losing their commercial values.

When the water-dispersible sheet according to the present invention is used as filter joining paper, the sheet is subject to monochrome printing or two to five colors printing by gravure or flexographic press to be patterned with stripes, logo-marks, a tobacco brand, or a ground design of cork, and then subject to cutting to have the prescribed width as filter joining paper. When the sheet is used as filter plug wrap, the sheet is subject to cutting so as to have the prescribed width as filter plug wrap.

As mentioned above, the present invention have features as follows.

In the first to sixth embodiments of the present invention, water-dispersible fibers having the specified fiber dimensions and the specified water retention value are used as fibrous raw materials for the base paper. Therefore, the water-dispersible fibers are hardly swollen or collapsed in the process of forming the paper web during drainage and drying, and bondings of the fibers one another are weak, so that the water-resolvable base paper which is easy to disperse in water can be obtained.

In the second, fourth and sixth embodiments of the present invention, water-insoluble or water-slightly-soluble powder is mixed with the fibrous raw materials in the process of forming the water-resolvable base paper. Accordingly, the fibers are prevented from being in contact with one another and the bondings among the fibers become weak, so that the water-resolvable base paper, which is capable of more easily dispersing in water, can be obtained as compared with the case that such powder is not added.

In the third and fourth embodiments of the present invention, the base paper is made through an alkali impregnation treatment after the process of forming a paper web by drainage and drying. Since the water-dispersible fibers become easy to swell in an alkaline state, fibers in the base paper treated by alkali swell in water and are easy to separate, and the water-dispersibility of the water-resolvable base paper improves.

In the fifth and sixth embodiments of the present invention, the salt of fibrous carboxymethyl cellulose or the salt of fibrous carboxyethyl cellulose is added into the paper stock during the making of the water-resolvable base paper. These salts swell and gel in water, so that the bondings between the salt and the fibrous raw material are easily dissociated and the water-dispersibility of the base paper is elevated.

In the seventh and eighth embodiments of the invention, fibrous carboxymethyl cellulose acid or fibrous carboxyethyl cellulose acid is used as a part of the fibrous raw materials, and the water-resolvable base paper is made through an alkali impregnation treatment after the formation of the paper web. As a result, the fibrous carboxymethyl cellulose acid or the fibrous carboxyethyl cellulose acid forms the corresponding salt which is soluble and capable of swelling in water, and consequently the bondings between the salt and the fibrous raw material are easily dissociated and the water-dispersibility of the base paper is elevated. In comparison with the fifth or sixth embodiment, in which salt of fibrous carboxymethyl cellulose or salt of fibrous carboxyethyl cellulose is added into the paper stock and a part of the salt dissolves and flows out during drainage, in the seventh and eighth embodiments, fibrous carboxymethyl cellulose acid or fibrous carboxyethyl cellulose acid, which is insoluble in water, is added into the paper stock, and such acid is held in the paper web without flowing out during drainage. Therefore, the base paper having higher water-dispersibility can be obtained.

The water-dispersible sheets produced in accordance with the present invention, have a property of easily decomposing by rainwater as well as a property of the air-permeability of the similar level to the usual filter plug wrap and filter joining paper used conventionally for filter parts of cigarettes. Accordingly, when the filter plug wrap and the filter joining paper produced from the sheets of the present invention are used for cigarettes, the cigarette butt thrown away can be easily decomposed by rainwater and then the present invention contributes to maintenance and beautification of environment.

In the following experimental examples, water-dispersion rate, water-dispersion period, gas-permeability and tensile strength are evaluated by the methods mentioned below.

[water-dispersion rate]

Ten test pieces of 2.5 cm×2.5 cm are prepared. Five of them are used as samples for measuring the moisture content, and the other five pieces are used as test pieces for measuring the water-dispersion rate. The bone dry weight of the test piece is calculated from the moisture content by the undermentioned equation (I).

Next, 200 ml of deionized water is poured into a 200 ml beaker, and the above five test pieces for measuring the water-dispersion rate are thrown into the water one after another, while the water is stirred at 600 rpm with stirrer.

After the prescribed period of stirring, the content of the beaker is filtered through a standard sieve of 1.7 mm aperture, and then, after drying for over 5 hours at a temperature of 105° C., the bone dry weight is measured. The stirring period is 5 or 20 minutes and the water-dispersion rate is obtained from the undermentioned equation (II) It is evaluated that the larger the value of the water-dispersion rate, the higher the water-dispersibility.

The bone dry weight of the test piece=(the weight of the test piece)×(the bone dry weight of the sample for measuring the moisture content)÷(the air-dried weight of the sample for measuring the moisture content) (I)

The water dispersion rate=(the bone dry weight of the test piece−the bone dry weight of the residue on the sieve)÷(the bone dry weight of the test piece)×100 (II)

[water-dispersion period]

Five test pieces of 3 cm×3 cm are prepared. Next, 300 ml of deionized water is poured into a 300 ml beaker, and one of the the above five test pieces is thrown into the water, while the water is stirred at 650 rpm with stirrer.

The period from the time that the test piece is thrown into the water to the time that the test piece is torn off to two pieces is measured with a stopwatch, and the average value of the five time measurements is employed as the water-dispersion period. It is evaluated that the shorter the water-dispersion period, the higher the water-dispersibility.

[gas permeability]

The amounts of air-flow passing through 1 $cm^2$ surface of a sample for 1 minute at the differential pressure of 100 mm $H_2O$ are measured by using the paper permeability meter provided by FILTRONA Co., Ltd (model PPM100). When the air-permeability is less than 1 coresta, the air-resistance is measured by using the Oken type air-resistance tester provided by Asahi Seiko Co., Ltd (model KG1).

[tensile strength]

The tensile strength is measured according to JIS P8113.

EXPERIMENTAL EXAMPLE 1

This experimental example illustrates that the fibers having the specified fiber dimensions and the specified water retention value are easy to disperse in water.

The undermentioned four kinds of wood pulps differing in the fiber dimensions and the water retention value were provided. These wood pulps are referred to as wood pulp A, B, C and D respectively for convenience sake, and have the following properties at the time before beating.

wood pulp A (soft-wood bleached kraft pulp) l/D: 0.722, L/D: 79.6, water retention value 103% wood pulp B (hard-wood bleached kraft pulp) l/D: 0.480, L/D: 44.2, water retention value 109% wood pulp C (hard-wood bleached kraft pulp) l/D: 0.420, L/D: 57.6, water retention value 77% wood pulp D (hard-wood bleached kraft pulp) l/D: 0.330, L/D: 56.8, water retention value 93%

The above four kinds of pulps were subject to beating to the prescribed beating degrees using a beater standardized in JIS P8210, and then several kinds of laboratory papers (handsheets) having a basis weight of 27 g/m$^2$ or 37 g/m$^2$ were prepared according to JIS P8209, using the above wood pulps separately or mixtures thereof. In the mixtures, wood pulps were subject to beating to the same beating degree. The water-dispersion periods of the laboratory papers were measured and shown in Table 1 (on page 67). Hereupon, it is judged that the paper, in which the water-dispersion period is less than 90 second, has water-dispersibility.

As can be seen from Table 1, with respect to the laboratory paper prepared from the wood pulp A or B respectively, in which the fiber dimensions and the water retention value were beyond the prescribed range, the water-dispersion period was extremely long.

On the other hand, with respect to the laboratory paper prepared from the wood pulp C or D respectively, in which the fiber dimensions and the water retention value were within the prescribed range, or the laboratory papers prepared from the mixtures of not less than 20% by weight of wood pulp C or D and the wood pulp A as the remainder, the water-dispersion periods were extremely short, and so these laboratory papers were excellent in the water dispersibility.

EXPERIMENTAL EXAMPLE 2

This experimental example illustrates that the water-dispersibility of the base paper is improved by adding the water-insoluble or water-slightly-soluble powder into the wood pulp for making the base paper.

The same wood pulp A and C as used in Experimental Example 1 were prepared and subject to beating in the same manner as mentioned in Experimental Example 1 and were mixed in the various blends. As the water-insoluble or water-slightly-soluble powder, calcium carbonate or the mixture of calcium carbonate and titanium dioxide in the ratio of 6:1 was added to the resultant mixtures of wood pulps to make several kinds of laboratory papers (handsheets) having a basis weight of 27 g/m$^2$ or 37 g/m$^2$.

The water dispersibility of the paper was measured and the results were shown in Table 2 (on page 68). The content of the water-insoluble or water-slightly-soluble powder in the paper was indicated by ash content at 900° C. in JIS P8128.

In Table 2, the paper stock of Sample No.20 corresponds to that of Sample No. 14 in Table 1 with calcium carbonate, and the paper stock of Sample No.22 corresponds to that of Sample No. 7 in Table 1 with calcium carbonate. From Table 1 and 2, it is found that the water dispersibility is improved by adding the water-insoluble or water-slightly soluble powder to the wood pulp.

EXPERIMENTAL EXAMPLE 3

This experimental example illustrates that the water-dispersibility of the base paper is improved depending upon the amount of the water-insoluble or water-slightly-soluble powder added to the wood pulp.

The same wood pulp A and C as used in Experimental Example 1 were subject to beating to the level of 140 ml CSF by Canadian standard freeness and mixed in the blend ratio of 40 parts by weight of A and 60 parts by weight of C. 50, 100, 150 and 200 parts by weight of calcium carbonate were respectively added to 100 parts by weight of the mixed fibrous raw materials, and four kinds of the water-resolvable base papers having a basis weight of 27 g/m$^2$ were made according to JIS P8209. Water-dispersion period, water-dispersion rate, gas-permeability and tensile strength were measured and the results were shown in Table 3 (on page 69).

As can be seen from Table 3, the water-dispersibility is improved as the content of calcium carbonate in the water-resolvable base paper increases. However, there is a tendency that the air-permeability becomes high and the tensile strength becomes low, when the content of calcium carbonate increases.

The relationship of the content of calcium carbonate to the tensile strength of the base paper was obtained by extrapolation. From the result, it is inferred that when the content of calcium carbonate is more than 40% by weight, the tensile strength is less than 0.15 kgf. Therefore, it is desirable that the content of calcium carbonate is in the range of not more than 40% by weight for practical use, even if the tensile strength can be improved by a coating layer formed on the surface of the base paper.

EXPERIMENTAL EXAMPLE 4

This experimental example illustrates that the water-dispersibility of the base paper is improved by the alkali impregnation treatment for the paper web formed from wood pulp.

The same wood pulp A and C as used in Experimental Example 1 were subject to beating to the level of 450 ml CSF by Canadian standard freeness, and fibrous raw materials containing 20 parts by weight of A and 80 parts weight of C were prepared. 100 parts by weight of calcium carbonate was added to 100 parts by weight of the fibrous raw materials, and laboratory paper (handsheet) having a basis weight of 37 g/m$^2$ was obtained according to JIS P8209.

Next, sodium hydroxide and sodium carboxymethyl cellulose as a thickener were mixed, so that the alkaline solutions having the solid concentration of 0.07%, 0.7% or 5.89% by weight respectively were prepared. The above laboratory paper was dipped in each of the alkaline solutions. After an excess of the solution was squeezed from the paper, the paper was dried. Then, three kinds of water-resolvable base papers impregnated with alkali were produced. The water-dispersion period of the base paper and the pH values of the solutions, in which the base paper was dispersed, having a concentration of 1% by weight were measured, and the results were shown in Table 4 (on page 69).

As can be seen from Table 4, the water-dispersion period becomes short and the water-dispersibility is improved as the content of alkali increases.

EXPERIMENTAL EXAMPLE 5

This experimental example illustrates that the water-dispersibility of the base paper is improved by the addition of salt of fibrous carboxymethyl cellulose to the paper stock.

The same wood pulp A and C as used in Experimental Example 1 were subject to beating to the level of 600 ml CSF by Canadian standard freeness and a mixture of wood pulps containing 40 parts by weight of A and 60 parts by weight of C were prepared The prescribed amount of sodium salt of fibrous carboxymethyl cellulose having a degree of substitution of 0.43 was mixed with the above mixture of wood pulps, so that four kinds of fibrous raw materials as paper stocks were obtained. Then, from these paper stocks, four kinds of laboratory papers (handsheets) having a basis weight of 37 g/m$^2$ were produced according to JIS P8209. The water-dispersion rate of the laboratory papers was measured in the same manner as in Experimental Example 1 and the results were shown in Table 5 (on page 69). As can be seen from Table 5, the water-dispersibility is improved by the addition of sodium salt of fibrous carboxymethyl cellulose to the paper stock. The air-permeability of the above laboratory papers is in the proper range capable of being controlled within the prescribed value by the formation of the coating layer or by means of calendering.

EXPERIMENTAL EXAMPLE 6

There is no limitation concerning the fiber dimensions and the water retention value in the seventh or the eighth embodiment of the present invention. This Experimental Example illustrates that when alkaline impregnation treatment is carried out after a paper web was formed from the mixture of the fibrous carboxymethyl cellulose acid or the fibrous carboxyethyl cellulose acid and the water-dispersible fibers, the base paper has sufficient water-dispersibility, although the fiber dimensions and the water retention value of the water-dispersible fibers are out of the prescribed range as in the first to sixth embodiments.

The same wood pulp A and C as used in Experimental Example 1 were prepared as the water-dispersible fibers. After these wood pulps were subject to beating using the beater standardized in JIS P8210 to the prescribed level shown in Table 6 (on page 70), several kinds of fibrous raw materials were prepared by mixing wood pulp A and C in the various blend ratios and adding to the resultant mixture with the prescribed amount of fibrous carboxymethyl cellulose acid having a degree of substitution of 0.43 as shown in Table 6, and then several kinds of laboratory papers (handsheets) were produced according to JIS P8210. Each laboratory paper was dipped in a 5% aqueous solution of sodium carbonate or potassium carbonate for 30 seconds and after an excess of solution was squeezed from the paper, the paper was dried. With respect to the resultant paper treated with alkali, water-dispersion period and air-permeability were measured and the results were shown in Table 6.

As can be seen from Table 6, water-resolvable base paper having similar good water-dispersibility to that of the paper containing wood pulp C can be obtained by the addition of fibrous carboxymethyl cellulose acid and by means of the alkaline impregnation treatment, although the base paper does not contain wood pulp C.

The present invention will hereinafter be explained concretely by the examples, but the present invention is not restricted within these examples. The evaluating methods commonly employed in all examples are mentioned below.

[water-dispersion rate]

The water-dispersion rate was measured in the same manner as in the aforementioned Experimental Examples, but stirring period was 5 minutes in all cases.

The water-dispersion rate was measured in Examples 1 to 6, 9 to 11 and 13. In Examples 7, 8, 12 and 14, since the water-dispersion rates of almost all of the test pieces were approximately 100%, it is difficult to estimate significant difference among the samples, and therefore only the water-dispersion period was measured.

[water-dispersion period]

The water-dispersion period was measured in the same manner as in the aforementioned Experimental Examples. The water-dispersion period was measured in all Examples.

[gas permeability]

The air-permeability or the air-resistance was measured in the same manner as in the aforementioned Experimental Examples.

[smoothness]

The smoothness was measured according to JAPAN TAPPI No. 5.

[tensile strength]

The tensile strength was measured according to JIS P8113.

[percentage of weight decrease in continuous rainfall test]

Filter parts of cigarettes for investigation were put in the combined cycle weather meter provided by SUGA TESTER Co., ltd, and after water was supplied continuously for 30 hours, the bone dry weight of the filter part was measured.

The percentage of weight decrease was obtained from the following equation.

(percentage of weight decrease) (%)=(the bone dry weight before rainfall−the bone dry weight after rainfall)÷(the bone dry weight before rainfall)×100

EXAMPLE 1

Hard-wood bleached kraft pulp, which had a l/D value of 0.330 and a L/D value of 56.8 as fiber dimensions and a water retention value of 93%, and soft-wood bleached kraft pulp, which had a l/D value of 0.722 and a L/D value of 79.6 as fiber dimensions and a water retention value of 103%, were subject to beating to the beating degree of 600 ml CSF by Canadian standard freeness. A paper stock was prepared by mixing 60 parts by weight of the hard-wood bleached kraft pulp with 40 parts by weight of the soft-wood bleached kraft pulp, and laboratory paper (water-resolvable base paper) having a basis weight of 38 g/m$^2$ was made from the paper stock according to JIS P8209.

Next, 50 parts by weight of poly(vinylalcohol) and 50 parts by weight of starch were mixed with water to prepare a clear coating liquid having a solid concentration of 20%.

This clear coating liquid was applied at the rate of 2.5 g/m$^2$ to each surface of one side or both sides of the base paper with a roll coater. Then, the coated base papers were finished by means of a super-calendering under a nip pressure of 175 kg/cm at a calender-roll temperature of 90° C. to produce calendered sheets.

For the resultant calendered sheets, air-permeability, water-dispersion rate, water-dispersion period, smoothness and tensile strength were measured. As to the one-side coated sheet (sample No.1-1) or the both-sides coated sheet (sample No.1-2), respectively, the air-permeability was 77 coresta or 83 coresta, the water-dispersion rate (stirring period: 5 minutes) was 44% or 38%, the water-dispersion period was 40 seconds or 52 seconds. From these results, it is found that water-dispersible sheets having a low air-permeability and a superior water-dispersibility can be obtained. Further, These sheets had a tensile strength of 3.7 kgf or 5.0 kgf and a smoothness of 232 second/10 ml or 238 second/10 ml, respectively. Therefore, these sheets had properties suitable for use as filter joining paper or filter plug wrap for cigarettes.

EXAMPLE 2

Hard-wood bleached kraft pulp, which had a l/D value of 0.420 and a L/D value of 57.6 as fiber dimensions and a water retention value of 77%, and soft-wood bleached kraft pulp, which had a l/D value of 0.722 and a L/D value of 79.6 as fiber dimensions and a water retention value of 103%, were subject to beating to the beating degree of 600 ml CSF by Canadian standard freeness. A paper stock was prepared by mixing 30 parts by weight of powder of kaolin or calcium carbonate with 80 parts by weight of the hard-wood bleached kraft pulp and 20 parts by weight of the soft-wood bleached kraft pulp, and laboratory paper (water-resolvable base paper) having a basis weight of 38 g/m$^2$ was made from the paper stock according to JIS P8209.

Next, 50 parts by weight of poly(vinylalcohol) and 50 parts by weight of starch were mixed with water to prepare a clear coating liquid having a solid concentration of 20%.

This clear coating liquid was applied at the rate of 2.5 g/m$^2$ to each surface of one side or both sides of the base paper with a roll coater. Then, the coated base papers were finished by means of a super-calendering under a nip pressure of 175 Kg/cm at a calender-roll temperature of 90° C. to produce calendered sheets.

For the resultant calendered sheets (sample No. 2-1 to No.2-4), air-permeability, water-dispersion rate, water-dispersion period, smoothness and tensile strength were measured and the results were shown in Table 7 (on page 71). As can be seen from Table 7, any sample had an air-permeability of less than 200 coresta and a superior water-dispersibility, and further, both of the tensile strength and the smoothness of any sample were suitable values for use as filter joining paper or filter plug wrap for cigarettes.

EXAMPLE 3

Hard-wood bleached kraft pulp, which had a l/D value of 0.420 and a L/D value of 57.6 as fiber dimensions and a water retention value of 77%, and soft-wood bleached kraft pulp, which had a l/D value of 0.722 and a L/D value of 79.6 as fiber dimensions and a water retention value of 103% were subject to beating to the beating degree of 600 ml CSF by Canadian standard freeness. A paper stock was prepared by mixing 60 parts by weight of the hard-wood bleached kraft pulp with 40 parts by weight of the soft-wood bleached kraft pulp, and laboratory paper (handsheet) having a basis weight of 38 g/m$^2$ was made from the paper stock according to JIS P8209.

Sodium carbonate or potassium carbonate was used as the alkaline compound to prepare an aqueous alkaline solution, and sodium carboxymethyl cellulose as a water-soluble polymer having a compatibility with said solution was added to said solution. The blend percentage of (alkaline compound):(sodium carboxymethyl cellulose) was 3:2 by weight, the solid concentration was 8% by weight and Brookfield type viscosity was 70 CPS. The above laboratory paper was subject to alkaline impregnation treatment with the above aqueous alkaline solutions by using a size-press apparatus to make water-resolvable base papers impregnated with alkali. The amount of alkaline compound absorbed in the base paper was 0.8 g/m$^2$ in both cases.

Next, 50 parts by weight of poly(vinylalcohol) and 50 parts by weight of starch were mixed with water to prepare a clear coating liquid having a solid concentration of 20%.

This clear coating liquid was applied at the rate of 2.5 g/m$^2$ to the surface of one side of the base paper impregnated with potassium carbonate, and was also applied at the rate of 2.5 g/m$^2$ to each surface of both sides of the base paper impregnated with sodium carbonate. Then, the coated base papers were finished by means of a super-calendering under a nip pressure of 175 Kg/cm at a calender-roll temperature of 90° C. to produce calendered sheets.

For the resultant calendered sheets, air-permeability, water-dispersion rate, water-dispersion period, smoothness and tensile strength were measured. As to the one-side-coated sheet impregnated with potassium carbonate (sample No.3-1) or the both-side-coated sheet impregnated with sodium carbonate (sample No.3-2), respectively, the air-permeability was 46 coresta or 26 coresta, the water-dispersion rate (stirring period: 5 minutes ) was 54% or 53%, the water-dispersion period was 30 seconds or 39 seconds. From these results, it is found that water-dispersible sheets having a low air-permeability and a superior water-dispersibility can be obtained. Further, These sheets had a tensile strength of 3.2 kgf or 4.9 kgf and a smoothness of 294 second/10 ml or 390 second/10 ml, respectively. Therefore, these sheets had properties suitable for use as filter joining paper or filter plug wrap for cigarettes.

EXAMPLE 4

Hard-wood bleached kraft pulp, which had a l/D value of 0.420 and a L/D value of 57.6 as fiber dimensions and a water retention value of 77%, and soft-wood bleached kraft pulp, which had a l/D value of 0.722 and a L/D value of 79.6 as fiber dimensions and a water retention value of 103%, were subject to beating to the beating degree of 600 ml CSF by Canadian standard freeness. A paper stock was prepared by mixing 30 parts by weight of powder of calcium carbonate with 80 parts by weight of the hard-wood bleached kraft pulp and 20 parts by weight of the soft-wood bleached kraft pulp, and laboratory paper (handsheet) having a basis weight of 38 g/m$^2$ was made from the paper stock according to JIS P8209.

The resultant laboratory paper was subject to the alkaline impregnation treatment in the same manner as that mentioned in Example 3 to make water-resolvable base papers.

Then, the base papers were coated with a clear coating liquid and finished by means of a super-calendering in the same manner as that in Example 3.

For the resultant calendered sheets, air-permeability, water-dispersion rate, water-dispersion period, smoothness and tensile strength were measured. As to the one-side-coated sheet impregnated with potassium carbonate (sample No.4-1) or the both-side-coated sheet impregnated with sodium carbonate (sample No.4-2), respectively, the air-permeability was 69 coresta or 23 coresta, the water-dispersion rate (stirring period: 5 minutes) was 74% or 83%, the water-dispersion period was 9 seconds or 26 seconds. From these results, it is found that water-dispersible sheets having a low air-permeability and a superior water-dispersibility can be obtained. Further, These sheets had a tensile strength of 2.6 kgf or 4.0 kgf and a smoothness of 333 second/10 ml or 298 second/10 ml, respectively. Therefore, these sheets had properties suitable for use as filter joining paper or filter plug wrap for cigarettes.

EXAMPLE 5

Hard-wood bleached kraft pulp, which had a l/D value of 0.330 and a L/D value of 56.8 as fiber dimensions and a water retention value of 93%, and soft-wood bleached kraft pulp, which had a l/D value of 0.722 and a L/D value of 79.6 as fiber dimensions and a water retention value of 103% were subject to beating to the beating degree of 600 ml CSF by Canadian standard freeness. The hard-wood bleached kraft pulp and the soft-wood bleached kraft pulp were blended in the ratio of 60%:40% (weight), and 95 parts by weight of the resultant blended wood pulp were mixed with 5 parts by weight of sodium salt of fibrous carboxymethyl cellulose (a degree of substitution: 0.43) to prepare a paper stock. A water-resolvable base paper having a basis weight of 37 g/m$^2$ was made from the paper stock by using a Fourdrinier paper machine.

Next, 50 parts by weight of poly(vinylalcohol) and 50 parts by weight of starch were mixed with water to prepare a clear coating liquid having a solid concentration of 20%.

This clear coating liquid was applied at the rate of 2.5 g/m$^2$ to each surface of both sides of the base paper with a roll coater. Then, the coated base paper was finished by means of a super-calendering under a nip pressure of 175 Kg/cm at a calender-roll temperature of 90° C. to produce a calendered sheet.

For the resultant calendered sheet (sample No. 5-1), air-permeability, water-dispersion rate, water-dispersion period, smoothness and tensile strength were measured. As a result, the air-permeability was 83 coresta, the water-dispersion rate (stirring period: 5 minutes) was 40%, the water-dispersion period was 81 seconds. Consequently, it is found that water-dispersible sheets having a low air-permeability and a superior water-dispersibility can be obtained. Further, The tensile strength was 4.7 kgf and the smoothness was 95 second/10 ml. Therefore, this sheet had properties suitable for use as filter joining paper or filter plug wrap for cigarettes.

EXAMPLE 6

Hard-wood bleached kraft pulp, which had a l/D value of 0.420 and a L/D value of 57.6 as fiber dimensions and a water retention value of 77%, and soft-wood bleached kraft pulp, which had a l/D value of 0.722 and a L/D value of 79.6 as fiber dimensions and a water retention value of 103% were subject to beating to the beating degree of 530 ml CSF by Canadian standard freeness. The hard-wood bleached kraft pulp and the soft-wood bleached kraft pulp were blended in the ratio of 60%:40% (weight), and 95 parts by weight of the resultant blended wood pulp were mixed with 5 parts by weight of sodium salt of fibrous carboxymethyl cellulose (a degree of substitution: 0.43), 30 parts by weight of powder of calcium carbonate and 5 parts by weight of powder of titanium dioxide to prepare a paper stock. A water-resolvable base paper having a basis weight of 38 g/m$^2$ was made from the paper stock by using a Fourdrinier paper machine.

Next, poly(vinylalcohol) (PVA) and starch were mixed with water in the various ratios as shown in Table 8 (on page 71) to prepare clear coating liquids having a solid concentration of 20% by weight. These clear coating liquids were applied at the rate of 2.5 g/m$^2$ to each surface of one side or both sides of the base paper with a roll coater. Then, the coated base papers were finished by means of a super-calendering under a nip pressure of 175 Kg/cm at a calender-roll temperature of 90° C. to produce calendered sheets.

For the resultant calendered sheets (sample No. 6-1 to No.6-6), air-permeability, water-dispersion rate, water-dispersion period, smoothness and tensile strength were measured and the results were shown in Table 8. As can be seen from Table 8, any sample had a low air-permeability and a superior water-dispersibility, and further, both of the tensile strength and the smoothness of any sample were suitable values for use as filter joining paper or filter plug wrap for cigarettes.

EXAMPLE 7

Hard-wood bleached kraft pulp, which had a l/D value of 0.480 and a L/D value of 44.2 as fiber dimensions and a water retention value of 109%, and soft-wood bleached kraft pulp, which had a l/D value of 0.722 and a L/D value of 79.6 as fiber dimensions and a water retention value of 103% were subject to beating to the beating degree of 500 ml CSF by Canadian standard freeness. A paper stock was prepared by mixing 11 parts by weight of fibrous carboxymethyl cellulose acid (a degree of substitution of 0.43) with 58 parts by weight of the hard-wood bleached kraft pulp and 42 parts by weight of the soft-wood bleached kraft pulp, and a base paper was made from the paper stock by using a Fourdrinier paper machine. Then, an aqueous sodium carbonate solution having a concentration of 5% by weight was applied to the base paper by using a size press apparatus to obtain a water-resolvable base paper impregnated with alkali having a basis weight of 41 g/m$^2$.

Next, various kinds of clear coating liquids shown in Table 9 (on page 72) were applied to each surface of one side or both sides of the base paper. Then, the coated base papers were finished by means of a super-calendering under a nip pressure of 175 Kg/cm at a calender-roll temperature of 90° C. to produce calendered sheets.

For the resultant calendered sheets (sample No. 7-1 to No.7-8), air-permeability, water-dispersion period, smoothness and tensile strength were measured and the results were shown in Table 9. As can be seen from Table 9, any sample had a low air-permeability and a superior water-dispersibility. Further, any sample had a sufficient tensile strength, and the smoothness was improved by calendering. Therefore these sheets had properties suitable for use as filter joining paper or filter plug wrap for cigarettes.

EXAMPLE 8

Hard-wood bleached kraft pulp, which had a l/D value of 0.480 and a L/D value of 44.2 as fiber dimensions and a water retention value of 109%, was subject to beating to the beating degree of 640 ml CSF by Canadian standard freeness. 75 parts by weight of the hard-wood bleached kraft pulp, 25 parts by weight of fibrous carboxymethyl cellulose acid (a degree of substitution: 0.43), 30 parts by weight of powder of kaolin and 5 parts by weight of powder of titanium dioxide were mixed to prepare a paper stock, and then laboratory paper (handsheet) was made from the paper stock according to JIS P8209.

Then, an aqueous sodium carbonate solution having a concentration of 8% by weight was applied to the paper by using a size press apparatus to obtain a water-resolvable base paper, which is impregnated with alkali, having a basis weight of 49 g/m$^2$.

Next, various kinds of clear coating liquids shown in Table 10 (on page 72) were applied to each surface of one side or both sides of the base paper. Then, in some cases, the coated base papers were finished by means of a super-calendering under a nip pressure of 175 Kg/cm at a calender-roll temperature of 90° C. to produce calendered sheets.

For the resultant sheets calendered or not calendered (sample No. 8-1 to No.8-5), air-permeability, water-dispersion period, smoothness and tensile strength were measured and the results were shown in Table 10. As can be seen from Table 10, any sample had an air-permeability of less than 1 coresta, which were in the level suitable for use as filter joining paper or filter plug wrap for cigarette, and because the water-dispersion period was short as within 10 to 20 seconds, it is found that the water-dispersible sheets having a low air-permeability and a superior water-dispersibility can be obtained. Further, any sample had a sufficient tensile strength, and the smoothness was improved by calendering. Therefore these sheets had properties suitable for use as filter joining paper or filter plug wrap for cigarettes.

EXAMPLE 9

The same paper stock as used in Example 1 was prepared, and a water-resolvable base paper having a basis weight of 38 g/m$^2$ was made from this paper stock by using Fourdrinier paper machine.

Next, a coating liquid, which comprised 70 parts by weight of powder of kaolin, 30 parts by weight of powder of titanium dioxide, 5.2 parts by weight of poly(vinylalcohol), 13.8 parts by weight of starch and 124 parts by weight of water, was applied to each surface of one side or both sides of the base paper with a blade coater to form water-dispersible coating layers containing water-insoluble powder to the surfaces of the base papers.

Then, two of the coated base papers were finished by means of a super-calendering under a nip pressure of 175 Kg/cm at a calender-roll temperature of 90° C. to produce calendered sheets.

For the resultant sheets calendered or not calendered (sample No. 9to -1 to No.9-4), air-permeability, water-dispersion rate, water-dispersion period, smoothness and tensile strength were measured and the results were shown in Table 11 (on page 73). As can be seen from Table 11, it is found that the sheets having a low air-permeability and a superior water-dispersibility can be obtained. Further, these sheets had a sufficient tensile strength, and the smoothness was improved by calendering. Therefore these sheets had properties suitable for use as filter joining paper or filter plug wrap for cigarettes.

EXAMPLE 10

The water-resolvable base paper having a basis weight of 38 g/m$^2$ was made in the same manner as in Example 4.

Next, a coating liquid, which comprised 70 parts by weight of powder of kaolin, 30 parts by weight of powder of titanium dioxide, 19 parts by weight of starch and 101 parts by weight of water, was applied to the surface of one side of the base paper with a blade coater to form a water-dispersible coating layer containing water-insoluble powder on the surface of the base paper.

Then, the coated base paper was finished by means of a super-calendering under a nip pressure of 175 Kg/cm at a calender-roll temperature of 90° C. to produce a calendered sheet.

For the resultant calendered sheet (sample No.10-1), air-permeability, water-dispersion rate, water-dispersion period, smoothness and tensile strength were measured and the results were shown in Table 11 (on page 73). As can be seen from Table 11, it is found that the sheet having a low air-permeability and a superior water-dispersibility can be obtained. Further, the sheet had a tensile strength and a smoothness which were suitable for use as filter joining paper or filter plug wrap for cigarettes.

EXAMPLE 11

The water-resolvable base paper having a basis weight of 38 g/m$^2$ was made in the same manner as in Example 6.

Next, a coating liquid, which comprised 70 parts by weight of powder of kaolin, 30 parts by weight of powder of titanium dioxide, 13.8 parts by weight of poly(vinylalcohol), 5.2 parts by weight of starch and 101 parts by weight of water, was applied to each surface of one side or both sides of the base paper with a blade coater to form water-dispersible coating layers containing water-insoluble powder on the surfaces of the base paper.

Then, the coated base papers were finished by means of a super-calendering under a nip pressure of 175 Kg/cm at a calender-roll temperature of 90° C. to produce calendered sheets.

For the resultant calendered sheets (sample No.11-1 and No.11-2), air-permeability, water-dispersion rate, water-dispersion period, smoothness and tensile strength were measured and the results were shown in Table 11 (on page 73).

As can be seen from Table 11, it is found that the sheets having a low air-permeability and a superior water-dispersibility can be obtained. Further, the sheets had a tensile strength and a smoothness which were suitable for use as filter joining paper or filter plug wrap for cigarettes.

EXAMPLE 12

Soft-wood bleached kraft pulp, which had a l/D value of 0.722 and a L/D value of 79.6 as fiber dimensions and a water retention value of 103%, and hard-wood bleached kraft pulp, which had a l/D value of 0.480 and a L/D value of 44.2 as fiber dimensions and a water retention value of 109% were subject to beating to the beating degree of 500 ml CSF by Canadian standard freeness. 40 parts by weight of the soft-wood bleached kraft pulp, 60 parts by weight of the hard-wood bleached kraft pulp, 10 parts by weight of fibrous carboxymethyl cellulose acid (a degree of substitution: 0.43), 30 parts by weight of powder of kaolin and 5 parts by weight of powder of titanium dioxide were mixed to prepare a paper stock, and then laboratory paper (handsheet) having a basis weight of 38 g/m$^2$ was made from the paper stock according to JIS P8209.

An aqueous sodium carbonate solution with a concentration of 5% by weight containing 30% by weight of methanol was applied to the base paper by using a size press apparatus to make an alkali impregnated water-resolvable base paper having a basis weight of 38 g/m$^2$.

Next, a coating liquid, which comprised 70 parts by weight of powder of kaolin, 30 parts by weight of powder of titanium dioxide, 19 parts by weight of starch and 101 parts by weight of water, was applied to the surface of one side of the base paper with a blade coater to form a water-dispersible coating layer containing water-insoluble powder on the surface of the base paper.

Then, the coated base paper was finished by means of a super-calendering under a nip pressure of 175 Kg/cm at a calender-roll temperature of 90° C. to produce a calendered sheet.

For the resultant calendered sheet (sample No.12-1), air-permeability, water-dispersion rate, water-dispersion period, smoothness and tensile strength were measured and the results were shown in Table 11 (on page 73). As can be seen from Table 11, it is found that the sheet having a low air-permeability and a superior water-dispersibility can be obtained. Further, the sheet had a tensile strength and a smoothness which were suitable for use as filter joining paper or filter plug wrap for cigarettes.

EXAMPLE 13

The water-resolvable base paper having a basis weight of 38 g/m$^2$ was made in the same manner as in Example 6.

Next, a coating liquid, which comprised 70 parts by weight of powder of kaolin, 30 parts by weight of powder of titanium dioxide, 13.8 parts by weight of poly(vinylalcohol), 5.2 parts by weight of starch and 101 parts by weight of water, was applied at the rate of 4.7 g/m$^2$ to the surface of one side of the base paper with a blade coater to form a water-dispersible coating layer containing water-insoluble powder. To the surface of the other side of the above base paper, a coating liquid, which comprised 40 parts by weight of poly(vinylalcohol), 60 parts by weight of starch and 567 parts by weight of water, was applied at the rate of 3.7 g/m$^2$ with a blade coater to form a water-dispersible coating layer without water-insoluble powder.

Then, the above both-side-coated base paper were finished by means of a super-calendering under a nip pressure of 175 Kg/cm at a calender-roll temperature of 90° C. to produce a calendered sheet.

The resultant calendered sheet (sample No.13-1) had an air-permeability of 66 coresta, an opacity of 71.6%, a water-dispersion period of 33 seconds, a smoothness of 323 second/10 ml and a tensile strength of 4.68 kgf. Therefore, this sheet had properties suitable for use as filter joining paper or filter plug wrap for cigarettes.

EXAMPLE 14

The water-resolvable base paper having a basis weight of 41 g/m$^2$ was made in the same manner as in Example 7.

Next, a coating liquid, which comprised 70 parts by weight of powder of kaolin, 30 parts by weight of powder of titanium dioxide, 19 parts by weight of starch and 101 by weight of water, was applied at the rate of 10 g/m$^2$ to the surface of one side of the base paper with a blade coater to form a water-dispersible coating layer containing water-insoluble powder.

To the surface of the other side of the base paper, a coating liquid, which comprised 45 parts by weight of copolymer of acrylic acid ester and acrylic acid, 55 part by weight of poly(vinylalcohol) and 285 by weight of water, was applied at the rate of 10.17 g/m$^2$ with a blade coater to form a water-dispersible coating layer without water-insoluble powder.

Then, the above both-side-coated base paper were finished by means of a super-calendering under a nip pressure of 175 Kg/cm at a calender-roll temperature of 90° C. to produce a calendered sheet.

The resultant calendered sheet (sample No.14-1) had an extremely low air-permeability of 280 second/100 ml, and the water-dispersion period of the sheet was an extremely short value of 11 seconds. Further, a smoothness was 320 second/10 ml and a tensile strength was 2.61 kgf. Therefore, this sheet has properties suitable for use as filter joining paper or filter plug wrap for cigarettes.

EXAMPLE 15 (for cigarettes)

The sheet of sample No.-11-2 in Example 11 (air-permeability: 86 coresta) was employed as body paper, patterned with a drawing by means of printing, and cut into a standard size of width to be filter joining paper (sample No.15).

Besides, a sheet was produced in a similar manner to sample No.11-2 in Example 11 except that the super-calendering is not carried out. The air-permeability of this sheet was 188 coresta. From this sheet, filter joining paper (sample No.16) was made in the same manner as mentioned above.

Further, as a comparative example, a sheet having a high air-permeability out of the scope of the present invention was produced by using the water-resolvable base paper made in Example 11 without forming the coating layer and by carrying out a super-calendering on the base paper under a nip pressure of 175 Kg/cm at a calender-roll temperature of 90° C. The air-permeability of this calendered sheet was 270 coresta, and filter joining paper as a comparative sample (sample No.17) was produced in the same manner as mentioned above.

On the other hand, hard-wood bleached kraft pulp, which had a l/D value of 0.420 and a L/D value of 57.6 as fiber dimensions and a water retention value of 77%, and soft-wood bleached kraft pulp, which had a l/D value of 0.722 and a L/D value of 79.6 as fiber dimensions and a water retention value of 103%, were subject to beating to the beating degree of 240 ml CSF by Canadian standard freeness.

The hard-wood bleached kraft pulp and the soft-wood bleached kraft pulp were blended in the ratio of 80%:20% (weight), and 95 parts by weight of the resultant blended wood pulp were mixed with 5 parts by weight of sodium salt of fibrous carboxymethyl cellulose (a degree of substitution: 0.43) and 65 parts by weight of powder of calcium carbonate to prepare a paper stock. A water-resolvable base paper having a basis weight of 30 g/m$^2$ was made from the paper stock by using a Fourdrinier paper machine. Next, a clear coating liquid of starch having a solid concentration of 20% was applied at the rate of 1 g/m$^2$ to each surface of both sides of the base paper with a roll coater. Then, the coated base paper was finished by means of a super-calendering under a nip pressure of 175 Kg/cm at a roll surface temperature of 90° C. to produce a calendered sheet. This calendered sheet had an air-permeability of 109 coresta, and then it was cut into the prescribed size to provide filter plug wrap (sample No.18).

As comparative samples, filter joining paper and filter plug wrap were prepared under the following usual conditions, and cigarettes were produced by using this filter joining paper and this filter plug wrap:

Hard-wood bleached kraft pulp, which had a l/D value of 0.530 and a L/D value of 55.3 as fiber dimensions and a water retention value of 116%, and soft-wood bleached kraft pulp, which had a l/D value of 0.786 and a L/D value of 77.6 as fiber dimensions and a water retention value of 91.5%, were subject to beating to the beating degree of 80 ml CSF by Canadian standard freeness. The hard-wood bleached kraft pulp and the soft-wood bleached kraft pulp were blended in the ratio of 50%:50% (weight), and 100 parts by weight of the resultant blended wood pulp were mixed with 30 parts by weight of powder of calcium carbonate to prepare a paper stock. From this paper stock, body paper for filter joining paper having a basis weight of 37 g/m$^2$ and body paper for filter plug wrap having a basis weight of 27 g/m$^2$ were made by using a Fourdrinier paper machine. Then, these body papers without surface-coating were finished by means of a super-calendering under a nip pressure of 175 Kg/cm at a calender-roll temperature of 90° C. to produce calendered sheets. The air-permeability of body paper for filter joining paper was 5 coresta and the air-permeability of body paper for filter plug wrap was 9 coresta. These body papers were cut into the prescribed sizes to provide a comparative filter joining paper (sample No.19) and a comparative filter plug wrap (sample No. 20), respectively.

The filter plug wraps (sample No. 18 and No. 20) were used to wrap acetate tow to form filter tips for cigarettes in the same manner as in the case of usual filter tips for cigarettes. In this process, there was no problem occurred on neither mechanical aspect nor qualities.

Further, four kinds of filter-tipped cigarettes were produced by way of experiment by combining the filter tips made as mentioned above and cigarette rods formed of one kind of tobacco wrapped with cigarette paper, by using filter joining papers (samples Nos. 15, 16, 17 and 19) shown in Table 12 (on page 74). In the making process of any sample, there was neither mechanical problem nor problems on qualities except components in smoke, and the results were fair. With respect to these filter tipped cigarettes, the draw resistance in cigarette, the tar content in smoke, the nicotine content in smoke and the number of smoking times were measured according to TIJO (Japan Tobacco Association) and the results were shown in Table 12, together with the data in which the percentages of weight decrease of filter joining paper and filter plug wrap after 30 hours in continues rainfall tests by using a combined cycle weather meter were compared.

From the results, cigarettes of trial products No. B and No. C had high percentages of weight decrease and had good water-dispersibility as compared with comparative trial product No. A, further the components in smoke scarcely decreased. Therefore, it can be concluded that papers used in trial products No. B and No. C are suitable for use as staffs for cigarettes. It is found that the nicotine content and the tar content in the cigarette of trial product No. D considerably decrease. Consequently, it can be conclude that paper having an air-permeability exceeding 200 coresta as trial product No. D is not suitable for use as filter joining paper since the content of components in smoke such as nicotine or tar decrease exceedingly.

TABLE 1

| | wood pulp composition | | | | | | properties of laboratory paper (handsheet) | | |
|---|---|---|---|---|---|---|---|---|---|
| | | | | | | | | water-dispersibility | |
| sample No. | kind of pulp | beating degree ml CSF | blend ratio % | kind of pulp | beating degree ml CSF | blend ratio % | basis weight g/m² | second | judgment |
| 1 | A | 400 | 100 | | | | 30 | 210 | x |
| 2 | B | 400 | 60 | A | 400 | 40 | 27 | 97 | x |
| 3 | B | 400 | 40 | A | 400 | 20 | 27 | 130 | x |
| 4 | B | 400 | 100 | | | | 27 | 150 | x |
| 5 | C | 300 | 20 | A | 300 | 80 | 37 | 76 | ○ |
| 6 | C | 400 | 60 | A | 400 | 40 | 27 | 45 | ○ |
| 7 | C | 140 | 60 | A | 140 | 40 | 27 | 84 | ○ |
| 8 | C | 260 | 60 | A | 260 | 40 | 27 | 68 | ○ |
| 9 | C | 500 | 60 | A | 500 | 40 | 27 | 41 | ○ |
| 10 | C | 600 | 60 | A | 600 | 40 | 27 | 15 | ○ |
| 11 | C | 600 | 60 | A | 600 | 40 | 37 | 29 | ○ |
| 12 | C | 600 | 70 | A | 600 | 30 | 27 | 13 | ○ |
| 13 | C | 600 | 80 | A | 600 | 20 | 27 | 10 | ○ |
| 14 | C | 600 | 80 | A | 600 | 20 | 37 | 26 | ○ |
| 15 | C | 600 | 100 | | | | 27 | 9 | ○ |
| 16 | D | 600 | 60 | A | 600 | 40 | 37 | 34 | ○ |
| 17 | D | 600 | 100 | | | | 27 | 18 | ○ |

TABLE 2

| | wood pulp composition | | | | | | content of powder in paper | | properties of laboratory paper (handsheet) | | |
|---|---|---|---|---|---|---|---|---|---|---|---|
| | | | | | | | | | | water-dispersibility | |
| sample No. | kind of pulp | beating degree ml CSF | blend ratio % | kind of pulp | beating degree ml CSF | blend ratio % | kind of powder | ash content | basis weight g/m² | second | judgement |
| 18 | C | 60 | 80 | A | 60 | 20 | $CaCO_3$ | 8.2 | 26.2 | 49 | ○ |
| 19 | C | 140 | 80 | A | 140 | 20 | $CaCO_3$ | 9.3 | 26.4 | 44 | ○ |
| 20 | C | 600 | 80 | A | 600 | 20 | $CaCO_3$ | 9.0 | 37.9 | 10 | ○ |
| 21 | C | 60 | 60 | A | 60 | 40 | $CaCO_3$ | 9.6 | 26.3 | 54 | ○ |
| 22 | C | 140 | 60 | A | 140 | 40 | $CaCO_3$ | 9.5 | 26.1 | 54 | ○ |
| 23 | C | 600 | 20 | A | 600 | 80 | $CaCO_3 + TiO_2$ | 3.7 | 37.3 | 19 | ○ |
| 24 | C | 300 | 20 | A | 300 | 80 | $CaCO_3 + TiO_2$ | 7.3 | 36.7 | 76 | ○ |

TABLE 3

| sample No. | $CaCO_3$ added parts by weight | content of $CaCO_3$ in paper % by weight | water dispersion rate (20 min.) % | water dispersion period second | water dispersion period judgement | air permeability coresta | tensile strength kgf |
|---|---|---|---|---|---|---|---|
| 25 | 50 | 4.0 | 48.7 | 57.7 | ○ | 93 | 2.01 |
| 26 | 100 | 8.3 | 49.2 | 57.8 | ○ | 130 | 1.55 |
| 27 | 150 | 11.1 | 53.7 | 55.8 | ○ | 180 | 1.29 |
| 28 | 200 | 13.9 | 53.0 | 50.8 | ○ | 227 | 1.20 |

TABLE 4

| sample No. | composition of alkaline solution: NaOH added parts by weight | CMC added as thickener parts by weight | solid concentration % by wt. | amount of alkali absorbed g/m² | water dispersion period second | pH value of dispersing solution |
|---|---|---|---|---|---|---|
| 29 | 0 | 0 | 0 | 0 | 66.9 | — |
| 30 | 0.014 | 0.0315 | 0.07 | 0.006 | 68.9 | 9.90 |
| 31 | 0.144 | 0.324 | 0.7 | 0.08 | 55.6 | 10.24 |
| 32 | 1.44 | 3.24 | 5.89 | 0.33 | 24.4 | 10.90 |

TABLE 5

| sample No. | wood pulp parts by weight | fibrous CMC-Na parts by weight | water dispersion rate (20 minutes) % | air permeability coresta |
|---|---|---|---|---|
| 33 | 100 | 0 | 52.8 | 735 |
| 34 | 95 | 5 | 64.3 | 983 |
| 35 | 90 | 10 | 64.9 | 1290 |
| 36 | 85 | 15 | 63.8 | 1397 |

TABLE 6

| sample No. | composition of fibrous raw materials: wood pulp A parts by weight | wood pulp A beating degree ml CSF | wood pulp C parts by weight | wood pulp C beating degree ml CSF | fibrous CMC-H parts by weight | fibrous CMC-H beating degree ml CSF | alkali impregnation treatment | properties of paper impregnated with alkali: basis weight g/m² | water-dispersion period second | water-dispersion period judgement | air-permeability coresta |
|---|---|---|---|---|---|---|---|---|---|---|---|
| 37 | 100 | 600 | 0 | | 0 | | none | 30.0 | 210 | x | — |
| 38 | 94 | 644 | 0 | | 6 | 733 | $Na_2CO_3$ | 25.3 | 13 | ○ | 56 |
| 39 | 90 | 310 | 0 | | 10 | 733 | $Na_2CO_3$ | 29.3 | 35 | ○ | 98 |
| 40 | 70 | 393 | 0 | | 30 | 733 | $K_2CO_3$ | 54.3 | 37 | ○ | 56 |
| 41 | 50 | 393 | 0 | | 50 | 314 | $Na_2CO_3$ | 54.4 | 45 | ○ | 48 |
| 42 | 63 | 644 | 31 | 644 | 6 | 733 | $Na_2CO_3$ | 29.0 | 6 | ○ | 57 |
| 43 | 18 | 455 | 72 | 455 | 10 | 733 | $K_2CO_3$ | 40.3 | 12 | ○ | 1196 |
| 44 | 0 | 220 | 90 | 220 | 10 | 733 | $Na_2CO_3$ | 28.6 | 55 | ○ | 392 |

TABLE 7

| sample No. | kind of powder | coated surface | basis weight of coated paper g/m² | air permeabililty coresta | water dispersion rate (5 min.) % | water dispersion period second | smoothness sec/10 ml | tensile strength kgf |
|---|---|---|---|---|---|---|---|---|
| 2-1 | kaoline | one side | 42.0 | 180 | 66.1 | 19.7 | 318 | 3.23 |
| 2-2 | kaoline | both sides | 44.1 | 15 | 78.0 | 19.2 | 327 | 4.80 |
| 2-3 | $CaCO_3$ | one side | 41.9 | 16 | 38.6 | 26.3 | 266 | 3.55 |
| 2-4 | $CaCO_3$ | both sides | 41.4 | 75 | 58.5 | 21.8 | 126 | 4.79 |

TABLE 8

| sample No. | PVA:starch weight ratio | coated surface side | basis weight of coated paper g/m² | air permeabililty coresta | water dispersion rate (5 min.) % | water dispersion period second | smoothness sec/10 ml | tensile strength kgf |
|---|---|---|---|---|---|---|---|---|
| 6-1 | 100:0 | one | 40.5 | 36 | 48.0 | 31.9 | 428 | 4.07 |
| 6-2 | 60:40 | one | 40.2 | 38 | 51.0 | 36.4 | 400 | 4.23 |
| 6-3 | 0:100 | one | 41.1 | 111 | 53.7 | 35.3 | 320 | 3.59 |
| 6-4 | 100:0 | both | 42.5 | 12 | 49.4 | 40.9 | 381 | 5.36 |
| 6-5 | 60:40 | both | 43.1 | 12 | 51.9 | 32.3 | 297 | 5.32 |
| 6-6 | 0:100 | both | 44.3 | 115 | 54.1 | 36.2 | 258 | 4.55 |

TABLE 9

| sample No. | composition of coating solution % | coated surface side | amount of coating g/m² | calendering | air resistance sec/100 ml | water dispersion period second | smoothness sec/10 ml | tensile strength kgf |
|---|---|---|---|---|---|---|---|---|
| 7-1 | X 100% | one | 11.9 | — | 18100 | 19 | 12 | 4.00 |
| 7-2 | X 100% | both | 23.4 | — | 18400 | 43 | 15 | 4.03 |
| 7-3 | X 100% | one | 11.9 | done | 20100 | 20 | 54 | 4.01 |
| 7-4 | X 100% | both | 23.4 | done | 24000 | 45 | 96 | 4.05 |
| 7-5 | Y 100% | one | 8.1 | — | 16 | 11 | 10 | 3.14 |
| 7-6 | Y 100% | one | 12.7 | done | 387 | 10 | 1014 | 2.22 |
| 7-7 | Y:Z = 45:55 | one | 10.7 | — | 174 | 19 | 10 | 2.90 |
| 7-8 | Y:Z = 45:55 | one | 10.7 | done | 267 | 17 | 161 | 2.92 |

coating solution X: copolymer of vinyl acetate and acrylic salt
coating solution Y: copolymer of acrylic ester and acrylic salt
coating solution Z: poly(vinyl alcohol)

TABLE 10

| sample No. | composition of coating solution % | coated surface side | amount of coating g/m² | calendering | air resistance sec/100 ml | water dispersion period second | smoothness sec/10 ml | tensile strength kgf |
|---|---|---|---|---|---|---|---|---|
| 8-1 | X 100% | one | 10.1 | — | 21000 | 20 | 55 | 6.85 |
| 8-2 | X 100% | one | 10.1 | done | 40000 | 21 | 208 | 6.88 |
| 8-2 | X 100% | both | 19.6 | — | 45000 | 21 | 59 | 6.94 |
| 8-3 | Y:Z = 70:30 | one | 11.8 | — | 21200 | 10 | 54 | 5.77 |
| 8-4 | Y:Z = 70:30 | one | 11.8 | done | 45000 | 11 | 204 | 5.94 |

coating solution X: copolymer of vinyl acetate and acrylic salt
coating solution Y: copolymer of acrylic ester and acrylic salt
coating solution Z: poly(vinyl alcohol)

TABLE 11

| sample No. | coated surface side | amount of coating g/m² | calendering | air permeability coresta | water dispersion rate (5 min.) % | water dispersion period second | smoothness sec/10 ml | tensile strength kgf |
|---|---|---|---|---|---|---|---|---|
| 9-1 | one | 3.0 | — | 182 | 45.4 | 49 | 9 | 4.94 |
| 9-2 | one | 3.0 | done | 83 | 43.9 | 51 | 95 | 4.67 |
| 9-3 | both | 7.0 | — | 58 | 41.5 | 50 | 10 | 4.82 |
| 9-4 | both | 7.0 | done | 22 | 41.1 | 52 | 143 | 5.07 |
| 10-1 | one | 7.5 | done | 74 | 67.2 | 18 | 198 | 3.67 |
| 11-1 | one | 4.0 | done | 104 | 48.0 | 59 | 353 | 2.57 |
| 11-2 | both | 6.6 | done | 86 | 55.5 | 35 | 340 | 2.83 |
| 12-1 | one | 6.4 | done | 122 | — | 10 | 287 | 2.58 |

TABLE 12

| | filter joining paper | | filter plug wrap | | | components in smoke | | | percentage of weight |
|---|---|---|---|---|---|---|---|---|---|
| trial product No. | sample No. | air permeability coresta | sample No. | air permeability coresta | draw resistance of product $mmH_2O$ | tar mg per 1 product | nicotine mg per 1 product | number of smoking times times | decrease after 30 hours % |
| A | 19 | 5 | 20 | 9 | 139 | 10.7 | 0.94 | 6.2 | 5.1 |
| B | 15 | 86 | 18 | 109 | 130 | 10.8 | 0.91 | 6.8 | 24.0 |
| C | 16 | 188 | 18 | 109 | 125 | 10.5 | 0.88 | 7.0 | 23.0 |
| D | 17 | 270 | 18 | 100 | 104 | 8.3 | 0.79 | 7.3 | 23.0 |

We claim:

1. A water-dispersible sheet for cigarettes, which comprises (1) a water-resolvable base paper made from fibrous raw materials containing not less than 20% by weight of water-dispersible fibers having fiber dimensions of a l/D value of 0.45 or lower and a L/D value of 60 or lower and a water-retention value of 95% or lower, and (2) a water-dispersible coating layer containing water-soluble polymer formed on the surface of at least one side of said base paper, whereby said sheet is adjusted to have an air-permeability of not more than 200 coresta measured with a paper permeability meter, or to have an air-resistance within the range of 0 to 50000 second/100 ml measured with an Oken type air-resistance tester.

2. A water-dispersible sheet for cigarettes, which comprises (1) a water-resolvable base paper made from fibrous raw materials containing not less than 20% by weight of water-dispersible fibers having fiber dimensions of a l/D value of 0.45 or lower and a L/D value of 60 or lower and a water-retention value of 95% or lower, wherein water-insoluble or water-slightly-soluble powder is mixed with said fibrous raw materials, and (2) a water-dispersible coating layer containing water-soluble polymer formed on the surface of at least one side of said base paper, whereby said sheet is adjusted to have an air-permeability of not more than 200 coresta measured with a paper permeability meter, or to have an air-resistance within the range of 0 to 50000 second/100 ml measured with an Oken type air-resistance tester.

3. A water-dispersible sheet for cigarettes, which comprises (1) a water-resolvable base paper made through an alkali impregnation treatment for a paper web formed from fibrous raw materials containing not less than 20% by weight of water-dispersible fibers having fiber dimensions of a l/D value of 0.45 or lower and a L/D value of 60 or lower and a water-retention value of 95% or lower, and (2) a water-dispersible coating layer containing water-soluble polymer formed on the surface of at least one side of said base paper, whereby said sheet is adjusted to have an air-permeability of not more than 200 coresta measured with a paper permeability meter, or to have an air-resistance within the range of 0 to 50000 second/100 ml measured with an Oken type air-resistance tester.

4. A water-dispersible sheet for cigarettes, which comprises (1) a water-resolvable base paper made through an alkali impregnation treatment for a paper web formed from fibrous raw materials containing not less than 20% by weight of water-dispersible fibers having fiber dimensions of a l/D value of 0.45 or lower and a L/D value of 60 or lower and a water-retention value of 95% or lower, wherein water-insoluble or water-slightly-soluble powder is mixing with said fibrous raw materials, and (2) a water-dispersible coating layer containing water-soluble polymer formed on the surface of at least one side of said base paper, whereby said sheet is adjusted to have an air-permeability of not more than 200 coresta measured with a paper permeability meter, or to have an air-resistance within the range of 0 to 50000 second/100 ml measured with an Oken type air-resistance tester.

5. A water-dispersible sheet for cigarettes, which comprises (1) a water-resolvable base paper made from fibrous raw materials containing not less than 20% by weight of water-dispersible fibers having fiber dimensions of a l/D value of 0.45 or lower and a L/D value of 60 or lower and a water-retention value of 95% or lower, wherein salt of fibrous carboxymethyl cellulose or salt of fibrous carboxyethyl cellulose is mixed with said fibrous raw materials, and (2) a water-dispersible coating layer containing water-soluble polymer formed on the surface of at least one side of said base paper, whereby said sheet is adjusted to have an air-permeability of not more than 200 coresta measured with a paper permeability meter, or to have an air-resistance within the range of 0 to 50000 second/100 ml measured with an Oken type air-resistance tester.

6. A water-dispersible sheet for cigarettes, which comprises (1) a water-resolvable base paper made from fibrous raw materials containing not less than 20% by weight of water-dispersible fibers having fiber dimensions of a l/D value of 0.45 or lower and a L/D value of 60 or lower and a water-retention value of 95% or lower, wherein salt of fibrous carboxymethyl cellulose or salt of fibrous carboxyethyl cellulose and water-insoluble or water-slightly-soluble powder are mixed with said fibrous raw materials, and (2) a water-dispersible coating layer containing water-soluble polymer formed on the surface of at least one side of said base paper, whereby said sheet is adjusted to have an air-permeability of not more than 200 coresta measured with a paper permeability meter, or to have an air-resistance within the range of 0 to 50000 second/100 ml measured with an Oken type air-resistance tester.

7. A water-dispersible sheet for cigarettes, which comprises (1) a water-resolvable base paper made through an alkali impregnation treatment for a paper web formed from fibrous raw materials containing water-dispersible fibers and fibrous carboxymethyl cellulose acid or fibrous carboxyethyl cellulose acid, and (2) a water-dispersible coating layer containing water-soluble polymer formed on the surface of at least one side of said base paper, whereby said sheet is adjusted to have an air-permeability of not more than 200 coresta measured with a paper permeability meter, or to have an air-resistance within the range of 0 to 50000 second/100 ml measured with an Oken type air-resistance tester.

8. A water-dispersible sheet for cigarettes, which comprises (1) a water-resolvable base paper made through an alkali impregnation treatment for a paper web formed from fibrous raw materials containing water-dispersible fibers and fibrous carboxymethyl cellulose acid or fibrous carboxyethyl cellulose acid, wherein water-insoluble or water-slightly-soluble powder are mixed with said fibrous raw materials, and (2) a water-dispersible coating layer containing water-soluble polymer formed on the surface of at least one side of said base paper, whereby said sheet is adjusted to have an air-permeability of not more than 200 coresta measured with a paper permeability meter, or to have an air-resistance within the range of 0 to 50000 second/100 ml measured with an Oken type air-resistance tester.

9. A water-dispersible sheet for cigarettes as claimed in claim 1, wherein the water-dispersible coating layer comprising water-soluble polymer contains water-insoluble or water-slightly-soluble powder in the ratio of not more than 20 parts per 1 part of the water-soluble polymer by weight.

10. A water-dispersible sheet for cigarettes as claimed in claim 1, wherein the water-dispersible coating layers are formed on the surfaces of both sides of the water-resolvable base paper.

11. A water-dispersible sheet for cigarettes as claimed in claim 1, wherein a water-dispersible coating layer consisting of water-soluble polymer is formed on the surface of one side of the water-resolvable base paper, and a water-dispersible coating layer containing water-insoluble or water-slightly-soluble powder in the ratio of not more than 20 parts per 1 part of the water-soluble polymer by weight is formed on the surface of the other side of the water-resolvable base paper.

12. A filter-tipped cigarette, wherein the sheet specified in any one of claims 1 to 8 is used as filter plug wrap.

13. A filter-tipped cigarette, wherein the sheet specified in any one of claims 1 to 8 is used as filter joining paper.

* * * * *